US006126295A

United States Patent [19]

Hillinger

[11] Patent Number: 6,126,295

[45] Date of Patent: Oct. 3, 2000

[54] FIBER OPTIC LIGHTING SYSTEM FOR RATCHETING WRENCH

[75] Inventor: George Hillinger, Los Angeles, Calif.

[73] Assignee: Alltrade Inc., Long Beach, Calif.

[21] Appl. No.: 09/374,457

[22] Filed: Aug. 13, 1999

[51] Int. Cl.[7] ..... B25B 23/18

[52] U.S. Cl. ..... 362/119; 362/120; 362/114; 362/204; 206/349

[58] Field of Search ..... 362/119, 120, 362/114, 195, 203, 204, 205, 217; 206/349; 81/63

[56] References Cited

U.S. PATENT DOCUMENTS 5,899,554 5/1999 Hsu ..... 362/119

6,033,081 5/1998 Huang ..... 362/119

*Primary Examiner*—Sandra O'Shea
*Assistant Examiner*—Bertrand Zeade
*Attorney, Agent, or Firm*—Robert R. Thornton

[57] ABSTRACT

A ratcheting wrench, of the type having an elongated handle connected at one end by a neck to a ratchet head having a drive stem, has a manually selectively operable source of illumination contained in the handle and a fiber optic rod bundle contained in the a channel formed in the neck. The fiber optic rod bundle transmits light from the illumination source through the channel so that the transmitted light exits the wrench adjacent the drive stem in a beam which illuminates a lateral work area below and in axial alignment with the drive stem.

5 Claims, 2 Drawing Sheets

FIBER OPTIC LIGHTING SYSTEM FOR RATCHETING WRENCH

BACKGROUND OF THE INVENTION

Field of the Invention

The present invention relates to hand held ratcheting wrenches in general and to devices which provide light on the element to be driven by such wrenches in particular.

In the prior art, in order to apply light to an element to be driven by a ratcheting wrench, lighted drive extension bars have been used. Such extension bars are shown, for example, in U.S. Pat. No. 4,253,134, issued Feb. 24, 1981 to H. T. Barnaby, and U.S. Pat. No. 5,477,434, issued Dec. 19, 1995 to D. D. Read. However, such devices have two principle disadvantages: they are separate from the ratcheting driver and so may become lost or mislaid or be in a distant location when needed, and they require additional space between the wrench and the element to be driven, which may not be available if the element to be driven is in a confined space, as often occurs when the use of the light extension bar would be most beneficial.

SUMMARY OF THE INVENTION

A ratcheting wrench, of the type having an elongated handle connected at one end by a neck to a ratchet head from which a drive stem depends, has a manually operable source of illumination contained in the handle, and a fiber optic element contained in a channel formed in the neck and which is operable to transmit light from the illumination source through the channel so that said transmitted light exits the wrench adjacent the drive stem in a beam which illuminates a lateral work area below and in axial alignment with the drive stem.

BRIEF DESCRIPTION OF THE DRAWING

The invention may be more readily understood by referring to the accompanying drawing, in which.

DETAILED DESCRIPTION OF THE PREFERRED EMBODIMENT

Figure 1:
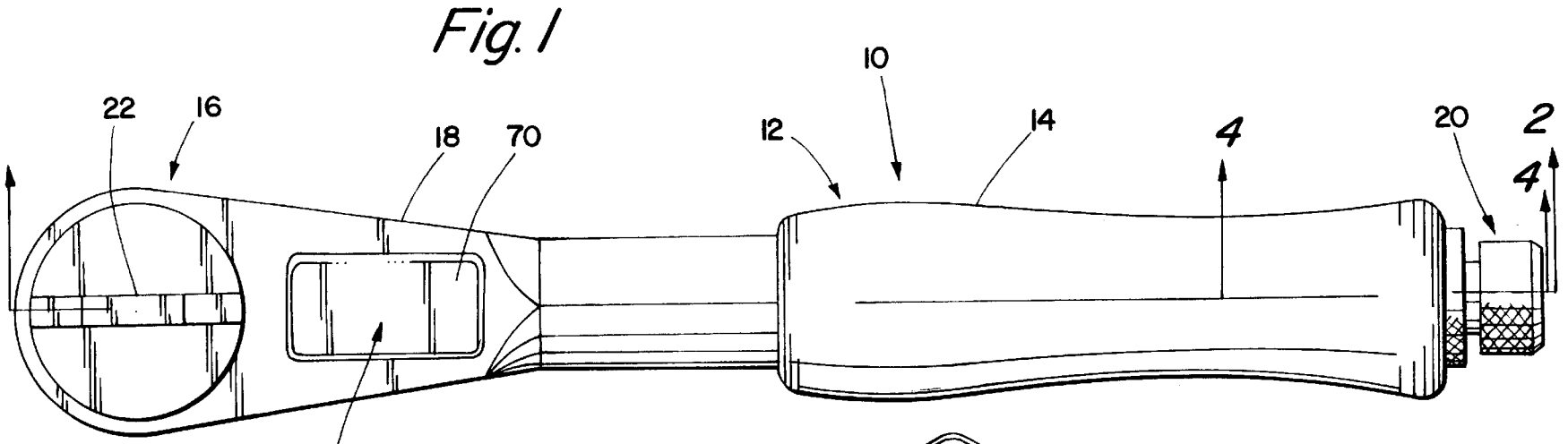
FIG. 1 is a plan view of a ratcheting wrench with a fiber optic lighting system according to the present invention.

Referring first to FIG. 1, a ratcheting wrench 10 has a handle 12 with a grip 14 formed about a portion thereof. The wrench 10 has a conventional ratchet head 16 which is connected to the handle 12 by a neck 18. At the opposite end of the handle 12 from the neck 18, an electrical switch element 20 is fixed to the handle 12. The ratchet head 16 has a ratcheting direction control knob 22 which controls the ratcheting direction of the wrench when torque is applied to the handle 12 by a user. The ratcheting head 16 and control knob 22 are conventional in design, and may be any one of a variety of such designs as are well known in the art, the ratchet head 16 with its ratcheting direction control knob 22 being shown by way of illustration only, and not by way of limitation.

Figure 2:
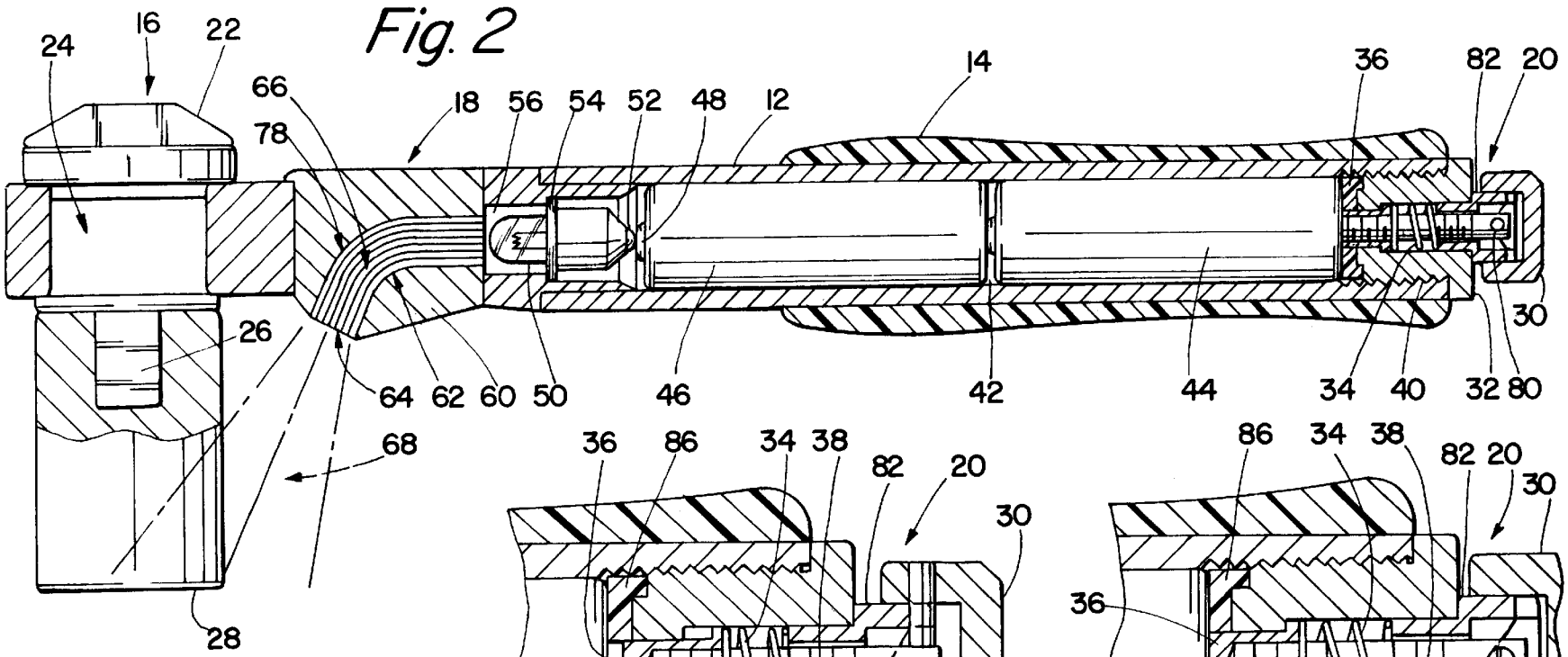
FIG. 2 is a right side elevation, in section, of the wrench of FIG. 1, taken along lines 2—2 of FIG. 1.

Referring now to FIG. 2, where the wrench 10 is shown in sectional side elevation, the ratchet head 16 includes a ratcheting mechanism 24, not shown in detail and which may be any one of the many well known designs for such a mechanism. The ratcheting mechanism 24 is positioned between the ratcheting direction control knob 22 and a conventional depending drive stem 26, which is shown for purposes of illustration as engaging a socket 28. The switch element 20 includes an actuator cap 30, a plug 32, a bias spring 34, and an electrical contact button 36. The cap 30 has a cap stem 38 which extends from the cap 30 to the contact button 36 inside of the bias spring 34. The plug 32 has threads 40 which threadably engage complementary threads formed within a hollow cylindrical interior 42 of the handle 12 so as to attach the switch element 20 to the handle 12.

The handle 12 has a source of electrical current, shown for purposes of illustration as a pair of batteries 44,46 disposed longitudinal alignment in the hollow interior 42. The battery 46 has a positive terminal 48 which is in electrical contact with a conventional electric bulb 50 at a bulb inner terminal 52 in conventional fashion. The bulb 50 has an outer terminal flange 54 which axially positions the bulb 50 in the handle interior 42 in conventional fashion by means of engagement of the flange 54 with a shoulder formed in a handle passageway 56 in conventional fashion.

A fiber optic element holder 60 is disposed in a complementary aperture formed the neck 18 between the passageway 56 and the ratchet head 16. The holder 60 has a channel 62 extending therethrough so as to communicate with the passageway 56 at one end and open onto the outer surface of the neck 18 adjacent the drive stem 26 at a light outlet aperture 64. The channel 62 contains a fiber optic element 66 of any appropriate fiber optic material for conducting light, such as a plurality of very small diameter fiber optic rods as shown in FIG. 2. Alternatively, a single fiber optic rod could be used if desired in an appropriately configured channel. Thus, the term "fiber optic element" as used herein comprehends the use of any number and/or types of fiber optic rods, and is used by way of description of the material, and not as a limitation as to the number of units comprising the "element."

Thus, the bulb 50 is contained entirely within the handle 12 and is not directly accessible from outside the handle, being shielded from the light outlet aperture 64 in the holder 60 by the fiber optic element 66. Rather, in order to have access the bulb 50, as is seen in FIG. 2, it is necessary to remove the switch element 20 by unscrewing the plug 32 which closes the hollow cylindrical interior 42 of the handle 12, then removing the button 36 and the batteries 44,46 from the hollow cylindrical interior 12, and finally removing the bulb 50 from the wrench 10 through the hollow cylindrical interior 42 of the handle 12.

A light beam 68, illustrated by dotted lines, is shown in FIG. 2 as emanating from the light outlet aperture 64 and shining on a lateral work area adjacent and in axial alignment with the drive stem 26, the lateral work area being occupied, in part, by the socket 28. However, as will be explained hereinafter, the switch 20 as shown in FIG. 2 is in its "off" position, so that the light beam 68 as shown in FIG. 2 will not exist until the switch 20 is moved to its "on" position, which is shown in FIG. 5.

Figure 3:
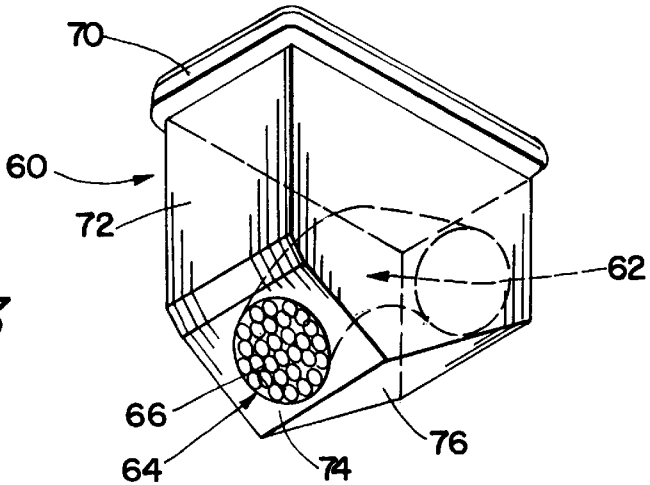
FIG. 3 is a view, in perspective, of a fiber optic element holder for use in the wrench of FIG. 1.

Referring now to FIG. 3, the fiber optic element holder 60 is shown in perspective. The holder 60 is polygonal in longitudinal cross section, having a top side 70, a front side 72, and a pair of bottom sides 74,76, which meet at an obtuse angle, the bottom side 74 containing the light outlet aperture 64. The channel 62 is shown in FIGS. 2 and 3 as being non-linear, with an elbow 78 functioning to provide a bend in the fiber optic element 66 so as to direct the light beam as desired on the lateral work area adjacent and in axial alignment with the drive stem 26.

Figure 4:
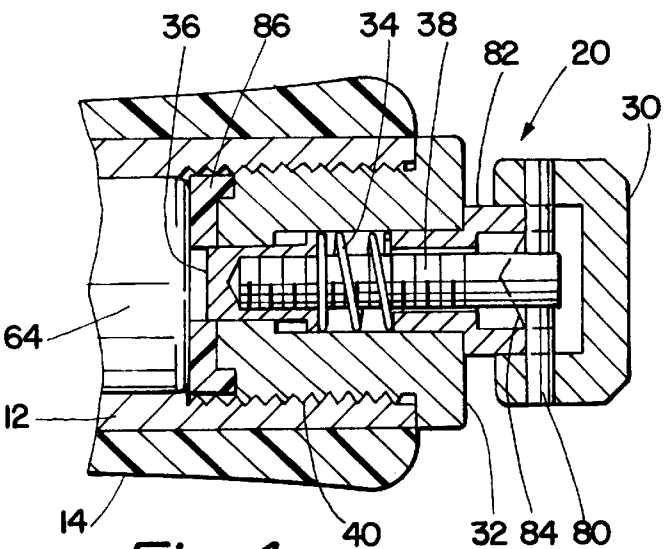
FIG. 4 is a partial right side elevational view, in section, taken along lines 4—4 of FIG. 1, illustrating in detail an electrical switch for the wrench as shown in FIG. 2, when the switch is in its "off" position.

In FIG. 4, the switch element 20 as shown in FIG. 2 is shown in greater detail in its "off" position. The cap 30 has a pin 80 extending diametrically across the interior thereof. The pin 80 engages a sleeve 82 in the plug 32. The bias spring 34 urges the cap stem 38 and so the electrical contact button 36 toward the battery 44, but the engagement of the pin 80 with the sleeve 82 holds the electrical contact button 36 away from the battery 44.

Figure 5:
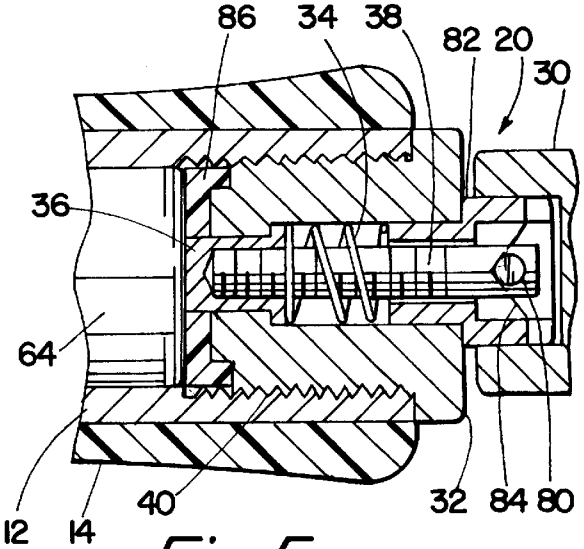
FIG. 5 is a partial right side elevational view, in section, illustrating in detail the electrical switch shown in FIG. 4, when the switch is in its "on" position.

As is best seen in FIG. 5, the sleeve 82 has a pair of diametrically opposite "V" notches 84. When the cap 30 is rotated to the position shown in FIG. 5, the notches 84 receive the pin 80, whereupon the bias spring 34 urges the electrical contact button 36 against the battery 44, thereby completing an electrical circuit from the electric bulb flange 54 through the handle 12, the plug 32, the electrical contact button 36, and the batteries 44,46 to the electric bulb inner terminal 34. When the electrical circuit is thus completed, light from the bulb 50 passes through the passageway 56 to the channel 62 of the fiber optic element holder 60, where it contacts the fiber optic element 66 and passes therealong to the opening 64, from which it emanates as illustrated in FIG. 2 so as to illuminate the lateral work area below the drive stem 26 in axial alignment therewith.

In the preferred embodiment, the plug 32 is separated from the battery 44 by an insulator 86 of any appropriate nonconductive material, shown for purposes of illustration in FIGS. 2, 4 and 5 as formed of a plastic material. The insulator has an axial bore extending therethrough, through which the electrical contact button passes when making contact with the battery 44. While FIG. 2 shows the use of two batteries 44, 46, the number of batteries used is selected so as to be appropriate to their voltage output and the voltage requirements of the electric bulb, as is conventional practice.

Although the presently preferred embodiment of the invention has been set forth herein in detail for illustrative purposes, it will be apparent to those skilled in the art that variations and modifications thereof, including the rearrangement of parts, lie within the scope of the present invention, which is not limited to the specific structures of the embodiments shown or described herein, but only by the scope of the following claims.

The invention claimed is:

1. In a ratcheting wrench of the type having an elongated handle and terminating in one end in a ratchet head having a depending drive stem, the combination of:

a light bulb contained entirely within the handle so as to be in axial alignment therewith and not externally accessible with respect thereto;

means for manually selectively actuating said light bulb to produce a beam of light in axial and longitudinal alignment with the handle and directed toward said ratchet head; and fiber optic means disposed within the handle between the light bulb and the ratchet head and operable to bend said beam of light from said light bulb through a portion of the wrench handle so that said bent light beam exits the wrench handle adjacent the drive stem in a beam in axial alignment with the drive stem so as to pass below the drive stem to illuminate a work area therebelow.

2. A wrench according to claim 1, and in which the wrench handle terminates at said one end in a neck portion which connects the handle to the ratchet head, and in which the fiber optic means includes a nonlinear channel formed in the neck portion with one end in axial alignment with the handle so as to extend from adjacent the light bulb to an exterior surface of the neck adjacent the ratchet drive stem and including an elbow portion therebetween, and an optical fiber element disposed in at least the elbow portion of said channel.

3. A wrench according to claim 2, and in which the optical fiber element is comprised of a plurality of optical fiber rods.

4. A wrench according to claim 2, and in which the optical fiber element extends substantially the length of the channel.

5. A wrench according to claim 3, and in which the optical fiber element extends substantially the length of the channel.

* * * * *